US005983970A

United States Patent [19]

Trygg

[11] Patent Number: 5,983,970

[45] Date of Patent: Nov. 16, 1999

[54] APPARATUS FOR APPLYING LABELS TO OBJECTS HAVING A HELICALLY GROOVED GLUINE ROLLER

[76] Inventor: Lars Erik Trygg, Box 243, S-372 24, Karlshamn, Sweden

[21] Appl. No.: 08/211,594

[22] PCT Filed: Oct. 13, 1992

[86] PCT No.: PCT/SE92/00718

§ 371 Date: Apr. 6, 1994

§ 102(e) Date: Apr. 6, 1994

[87] PCT Pub. No.: WO93/08082

PCT Pub. Date: Apr. 29, 1993

[30] Foreign Application Priority Data

Oct. 17, 1991 [SE] Sweden ..... 9103026

[51] Int. Cl.[6] ..... B65C 9/00

[52] U.S. Cl. ..... 156/566; 118/211; 118/212; 118/221; 271/33

[58] Field of Search ..... 156/566; 118/211, 118/212, 221; 271/33

[56] References Cited

U.S. PATENT DOCUMENTS

| | | | |
|---|---|---|---|
| 2,116,289 | 5/1938 | Shepherd | 118/212 |
| 3,008,449 | 11/1961 | Hauser | 118/212 |
| 3,648,651 | 3/1972 | Hinchcliffe et al. | 118/202 |
| 3,865,671 | 2/1975 | Kronsder | 156/488 |
| 4,066,808 | 1/1978 | Carter | 192/103 FA |
| 4,137,121 | 1/1979 | Müller | 156/571 |
| 5,174,852 | 12/1992 | Zepf | 156/566 |

FOREIGN PATENT DOCUMENTS

| | | |
|---|---|---|
| 2616916 | 8/1980 | Germany . |
| 3131164 | 2/1983 | Germany . |

*Primary Examiner*—Richard Crispino
*Assistant Examiner*—Linda L. Gray
*Attorney, Agent, or Firm*—Sughrue, Mion, Zinn Macpeak & Seas, PLLC

[57] ABSTRACT

An apparatus for applying labels to bottles or the like comprises at least one moveable gluing palette 7 which coacts with a rotary gluing roller 1 so as to be coated with glue, and which thereafter transfers the glue to a label 17 which is transported by the palette from a label magazine 11 to a gripper 12 which grips the glue-coated label and presses it onto a bottle 15. The outer cylindrical surface of the gluing roller is provided with helical grooves 2 which are kept filled with glue, and the outer layer 10 of each gluing palette is slightly elastic so that when the palette is urged into contact with the ridges 3 extending between the grooves on the gluing roller, parts of the outer layer will be pressed partially into the grooves so as to come into contact with the glue present in the grooves.

5 Claims, 1 Drawing Sheet

APPARATUS FOR APPLYING LABELS TO OBJECTS HAVING A HELICALLY GROOVED GLUINE ROLLER

BACKGROUND OF THE INVENTION

The present invention relates to an apparatus for applying labels to objects, such as bottles or the like, comprising at least one moveable gluing palette which is intended to coact with a rotary gluing roller so as to be coated with glue and thereafter to transfer glue to a label which is transported by the palette from a label magazine to a gripper which is intended to grip the glue-coated label and press the label onto the object concerned.

Devices of the aforedescribed kind are used, among other things, to apply labels to bottles in breweries, soft-drink bottling plants and like plants, which require the labelling devices to operate at high speed. The majority of these devices include a rubber gluing roller, aluminium gluing palettes and an adjustable glue scraper which is operative in determining the thickness of the glue on the gluing roller.

These known devices must be produced with extreme accuracy and any subsequent adjustments to the devices in operation must be effected very precisely, since, for instance, the gluing palettes may only partially penetrate the glue layer on the gluing roller without making contact with the outer surface of the roller itself, since such contact would force the glue layer carried by the roller out onto the edges of the palette. This would cause glue to splash or squirt onto the palette surroundings, and would also result in glue fastening to the front side of the labels, causing the labels to be drawn off the bottles. Loose labels which fasten to the gluing roller are difficult to remove and may result in damage to the roller, particularly when using foil labels, since such labels can cause wear on the roller when fastening between the glue scraper and the roller. A certain amount of wear can also be caused when the operator scrapes away labels that have fastened to the gluing roller with the aid of a sharp tool.

Another serious drawback with the known apparatus is that labels which fasten between the glue scraper and the gluing roller are liable to prevent the application of a fresh layer of glue on the roller, meaning that subsequent labels will not be completely coated with glue and that these glue-depleted labels will not stick to the very fast moving bottles. This may make it necessary to remove from the production line a very large number of bottles which lack labels.

Another factor is that the clearance between the gluing palettes and the gluing roller must not be excessive, since an excessive clearance will prevent the palettes from coming into contact with the glue, with the result that the labels will not be adequately coated.

The known apparatus are thus very sensitive to non-roundness of the gluing roller and also to wear on said roller, and require precise and play-free journalling of the roller.

DE-A1-3 131 164 describes a gluing machine or apparatus in which the gluing palettes are permitted to make contact with the gluing roller, wherein both the palettes and the roller are provided with mutually intersecting grooves. This arrangement, however, suffers several drawbacks, since, among other things, the ridges located between the grooves become coated with intersecting glue beads which are pressed out onto the edges of the palettes as the ridges come into contact with one another and splash down onto the surroundings and also result in glue fastening to the front side of the label.

SUMMARY OF THE INVENTION

The prime object of the present invention is to provide labelling apparatus with which the aforesaid drawbacks of known techniques are eliminated, among other things.

The invention is based on the realization that this object are achieved when the gluing roller and the gluing palette can be constructed so that the palettes are able to contact the outer surface of the roller without causing glue to splash down onto the surroundings. In this way, the extremely high tolerance requirements of known apparatus, with which the palettes are only permitted to penetrate partially into the actual glue layer, are avoided.

Accordingly, an apparatus in accordance with this invention is primarily characterized in that the cylindrical outer surface of the gluing roller is provided with grooves which are intended to be kept filled with glue; and in that at least the outer layer of each gluing palette is somewhat elastic so that when the palette is pressed into contact with the ridges located between the grooves on the gluing roller, parts of said outer layer will be pressed slightly into said grooves so as to come into contact with the glue present therein.

By using, in accordance with the invention, a grooved gluing roller in combination with gluing palettes having an elastic outer layer, the palettes, although they make contact with the surface of the roller,will not force out glue which penetrates up to the side edges of the palettes, while ensuring effective glue transfer at the same time.

It is preferred that the apparatus will include at least one nozzle by means of which glue is delivered to the roller, and that the grooves in the surface of the roller are held filled with glue with the aid of a scraper which coacts with the roller and which lies against the ridges extending between said grooves, so as to keep the ridges free from glue. The gluing roller is conveniently vertically oriented, and the glue nozzle is arranged at the upper end of the roller. The grooves provided in the gluing roller are preferably helical grooves which extend adjacent one another. Among other things, this provides a self-cleaning roller, since any labels which might stick to the roller will be "screwed" towards one end of the roller by the action of the glue scraper.

According to one preferred embodiment, the rotational speed of the gluing roller and the working cycle of the gluing palettes is chosen so that the ridges between the roller grooves will coact with at least partially different parts of respective palettes after each preceding contact occasion. This rotational speed of the gluing roller and the pitch of the grooves are preferably so selected that the ridge-contacting surfaces of the palettes are shifted slightly downwards on the palette between mutually sequential contacts of said palette surfaces with said ridges.

BRIEF DESCRIPTION OF THE DRAWINGS

The invention will now be described in more detail with reference to an exemplifying embodiment thereof illustrated in the accompanying drawings.

DETAILED DESCRIPTION OF THE PREFERRED EMBODIMENT

Figure 1:
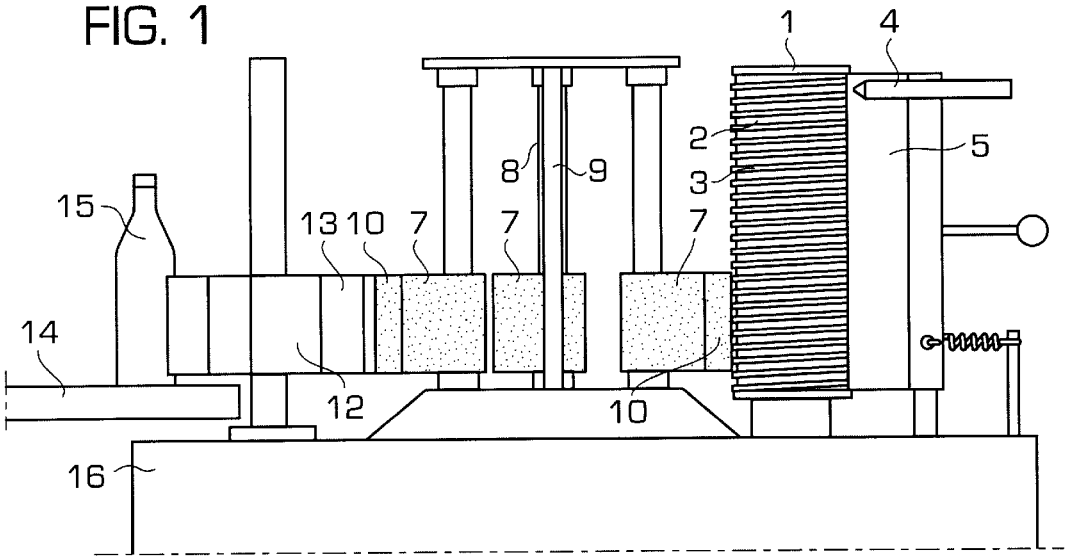
FIG. 1 is a side view of an inventive labelling apparatus.
Figure 2:
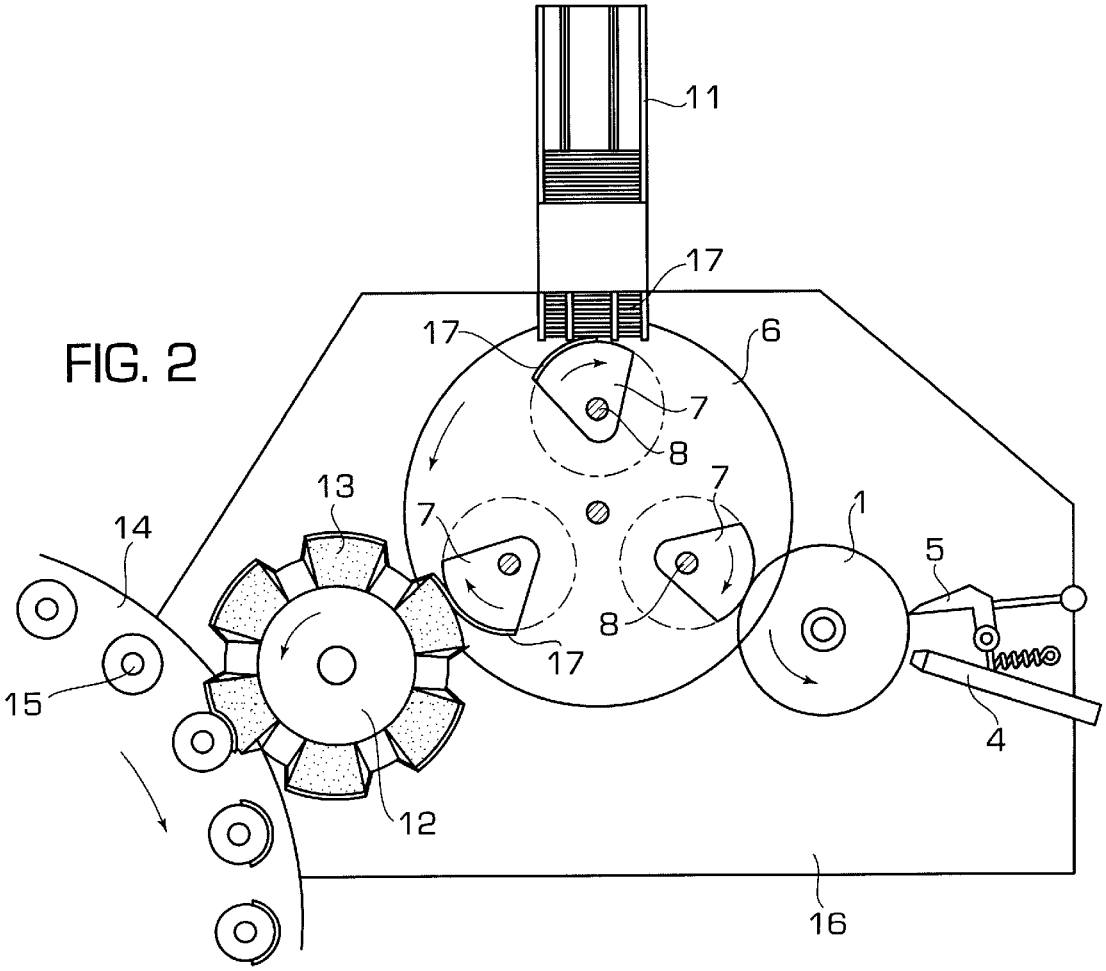
FIG. 2 is a view of the apparatus shown in FIG. 1 from above.

In the drawings, the reference numeral 1 identifies a vertically oriented, rotary gluing roller whose outer cylindrical surface is made of a hard material and provided with helical grooves 2, which are separated by intermediate ridges 3, conveniently flat ridges. The grooves are held filled with glue which is delivered to the grooves by means of an upper nozzle 4 and is distributed in the grooves and scraped from the ridges by means of a vertically oriented glue scraper 5 which resiliently abuts the ridges 3 separating the grooves 2 on the outer surface of the roller 1. This ensures that the ridges 3 will be kept free from glue.

The reference numeral 6 identifies a carousel, which in the illustrated case is provided with three glue palettes 7, each of which is mounted for limited pivotal rotation about an associated pivot shaft 8. The whole of the carousel 6 rotates about a centre shaft 9. The gluing palettes may be made of a solid elastic material or of metal and coated with an elastic outer layer 10, see FIG. 1, having a flat label-contacting surface.

The reference numeral 11 identifies a magazine for labels 17, while the reference numeral 12 identifies a rotary gripper provided with foam-rubber pads 13 having label-gripping devices. The reference numeral 14 identifies a carousel for bottles 15 which shall be labelled with labels taken from the magazine 11. The entire apparatus can be supported on a stand 16 which includes a gearbox having appropriate output shafts for the various rotational movements.

When the aforedescribed arrangement is in operation, each gluing palette 7 will pivot in relation to the gluing roller 1, in a conventional manner as the carousel 6 rotates, so that a layer of glue is applied to respective palettes 7 as they pass the roller. The palette then performs a corresponding movement as it passes the label magazine 11, wherein the first of the labels 17 in the magazine 11, in which the rear sides of the labels face forwards, fastens temporarily to the palette 7. When the label arrives at the gripping cylinder 12, as the carousel 6 rotates, the gripping devices in coaction with a foam-rubber pad 13 take the label from the palette 7 and, as the cylinder 12 rotates, press the glue-coated surface of the label against the appropriate bottle 15 on the bottle carousel 14, in a conventional manner. Transfer of the label from the palette 7 to the gripping cylinder 12 and pressing of the label onto the bottle 15 may also take place in a conventional manner.

In accordance with the present invention, the aforedescribed apparatus is primarily characterized in that the gluing roller is provided with grooves 2 and that the gluing palettes 7 have an elastic outer layer 10. As before mentioned, this enables the gluing palettes 7 to make contact with the gluing roller and to perform a rolling movement in relation thereto, without glue being forced out onto the edges of the palettes and while ensuring that glue will be effectively transferred as a result of the aforesaid partial penetration of the elastic outer layer on the gluing palettes into the glue-filled grooves on the roller.

This greatly reduces the necessary manufacturing and adjustment tolerances, which, among other things, also reduces both manufacturing costs and operating costs and provides an apparatus which is much more reliable in operation and which ensures that a good result will be achieved.

The grooves 2 on the gluing roller 1 will preferably have the form of helical grooves so that, among other things, a label or some other object which might fasten to the gluing roller will be automatically "screwed" downwards along the roller by the action of the scraper 5 as it moves along the ridges. The roller thus becomes self-cleaning, which is highly advantageous. Scrap and surplus glue can be collected at the bottom end of the roller.

In order to avoid the ridges 3 located between the grooves 2 on the roller 1 from becoming coated with glue, the gluing palettes 7 will preferably coact with essentially the same surface on the gluing roller on each rolling occasion. In order, however, to avoid uneven wear on the outer surface of the gluing palettes, it is preferred that the rolling surface is shifted slightly between sequential contact of a gluing palette with the roller. To this end, the rotational speed of the gluing roller is adapted in relation to the working cycle of the gluing palettes, so that the roller will not rotate through a complete revolution or through several complete revolutions between each palette rolling movement. However, it is necessary that the peripheral speeds of the roller and the palette essentially coincide.

The rotational speed of the gluing roller and the pitch of the glue grooves are conveniently chosen so that the palette-contacting surfaces of the ridges will engage the palette successively at locations which are slightly displaced downwards in relation to preceding engaging locations. The distance through which the contact surfaces are displaced between each contact occasion may be on the order of some hundredths of a millimeter.

The grooves may be relatively shallow, on the order of some tenths of a millimeter, depending on the desired thickness of the glue layer and on the quality of the glue used. The grooves may have a width of some millimeters, depending on the size of the label surface required to be coated with glue. By allowing the pitch of the grooves to vary along the gluing roller, the amount of glue can be varied between different parts of a label or between labels that are located at different heights. In addition to helical grooves, horizontal, circumferential grooves may also be used for instance, and the pitch between these grooves may be varied as desired.

The novel features of the present invention can be applied with different types of labelling apparatus, for instance irrespective of the number of palettes used, the type of label magazine used, and the construction of the gripping devices mounted on the gripper. Furthermore, the palette carousel may be arranged to rotate in one direction or to pivot backwards and forwards between two positions.

I claim:

1. An apparatus for labelling objects, comprising at least one moveable gluing palette (7) adapted to coact with a rotary gluing roller (1) so as to be coated with glue and thereafter to transfer the glue to a label (17) received onto the glue on the palette from a label magazine (11) and then transported to a gripper (12) intended to grip the glue-coated label and to press the glue-coated label onto an object (15), wherein an outer cylindrical surface of the gluing roller is provided with mutually adjacent grooves (2) adapted to be kept filled with the glue; and at least an outer layer (10) of each said gluing palettes are slightly elastic so that when the palette is individually urged into contact with ridges (3) extending between the grooves on the gluing roller (1), parts of said outer layer will be pressed partially into the grooves so as to come into contact with the glue present in said grooves, and further comprising means for implementing a self-cleaning roller function, said implementing means comprising the roller grooves being helically configured, and a scraper (5) coacting with the roller and lying against the ridges extending between the grooves to keep the ridges free from the glue such that the scraper cooperates with the helical grooves to screw advance any label or other foreign object adhering to the gluing roller to one end of the roller.

2. An apparatus according to claim 1, further comprising at least one nozzle (4) which functions to deliver the glue to the roller, wherein the gluing roller is vertically oriented, and the glue nozzle is mounted at an upper end of the roller.

3. An apparatus according to claim 1, wherein a rotational speed of the gluing roller and a working cycle of the gluing palettes (7) are chosen so that the ridges between the roller grooves will coact with at least partially different regions of respective gluing palettes (7) on each successive contact with the palette.

4. An apparatus according to claim 3, wherein the rotational speed of the gluing roller and a pitch of the grooves are chosen so that surfaces of the ridges which come into contact with the respective gluing palettes will be displaced slightly downwards on the palette between each successive contact of the ridges with said palette.

5. An apparatus according to claim 4, wherein the pitch of the grooves varies between different parts of the roller.

* * * * *